US011878781B1

(12) United States Patent
Masi

(10) Patent No.: US 11,878,781 B1
(45) Date of Patent: Jan. 23, 2024

(54) PADDLEBOARD PADDLE SYSTEM

(71) Applicant: Douglas J. Masi, Goodyear, AZ (US)

(72) Inventor: Douglas J. Masi, Goodyear, AZ (US)

( * ) Notice: Subject to any disclaimer, the term of this patent is extended or adjusted under 35 U.S.C. 154(b) by 357 days.

(21) Appl. No.: 17/407,987

(22) Filed: Aug. 20, 2021

Related U.S. Application Data

(60) Provisional application No. 63/067,970, filed on Aug. 20, 2020.

(51) Int. Cl.
*B63H 16/04* (2006.01)
*B63B 32/77* (2020.01)

(52) U.S. Cl.
CPC ..... *B63H 16/04* (2013.01); *B63B 32/77* (2020.02)

(58) Field of Classification Search
CPC ..... B63H 16/04; B63B 32/77
See application file for complete search history.

(56) References Cited

U.S. PATENT DOCUMENTS 3,039,120 A * 6/1962 Powell ..... B63H 16/04 416/63
4,493,663 A * 1/1985 Richmond ..... B63H 16/04 441/59
4,820,216 A 4/1989 Masters
5,832,563 A * 11/1998 Simpson ..... A63B 71/0009 16/110.1
6,022,255 A * 2/2000 Lukanovich ..... B63H 16/04 440/101
6,328,617 B1 12/2001 Gunnell
7,367,858 B2 5/2008 Matuska et al.
8,100,733 B1 * 1/2012 Ross ..... B63H 16/04 440/101
D693,285 S * 11/2013 Hall ..... D12/215
8,632,371 B1 * 1/2014 Ramsey ..... B63H 16/04 440/101
8,926,384 B1 * 1/2015 Alphin ..... B63H 16/04 440/101
9,248,896 B2 2/2016 Bergman
9,440,721 B2 9/2016 Marino et al.
9,499,246 B2 11/2016 Shoemaker et al.
9,586,662 B2 3/2017 Cyr
10,737,751 B2 * 8/2020 Dobbins ..... B63H 16/04
(Continued)

FOREIGN PATENT DOCUMENTS

WO WO-2023056406 A1 * 4/2023

*Primary Examiner* — Andrew Polay
(74) *Attorney, Agent, or Firm* — Invention To Patent Services; Alex Hobson

(57) ABSTRACT

A paddleboard paddle system is convertible from a single paddle to a double-paddle and has a paddle handle including a hand aperture and thumb aperture in the paddle portion. A paddleboard paddle has a first paddle portion and a second paddle portion that can be connected to form a double-paddle, or a paddle having a paddle portion on opposing end of the paddle arm. A paddle arm is the rod or extension from the paddle portion that is typically used to guide the paddle through the water. A user may use the single paddle while standing on the paddle board or may connect the second paddle portion to produce the double-paddle to use while sitting on the paddleboard or for use in a kayak. Also, a user may use a double-paddle while standing. The paddle handle may be gripped by the user to guide the opposing end through the water.

20 Claims, 9 Drawing Sheets

(56) References Cited

U.S. PATENT DOCUMENTS

| | | | | |
|---|---|---|---|---|
| 2005/0153606 | A1* | 7/2005 | Lane | B63H 16/04<br>440/101 |
| 2011/0011432 | A1 | 1/2011 | Yakos et al. | |
| 2014/0248075 | A1* | 9/2014 | Lee | F16B 7/1454<br>403/109.1 |

* cited by examiner

PADDLEBOARD PADDLE SYSTEM

CROSS-REFERENCE TO RELATED APPLICATIONS

This application claims the benefit of priority to U.S. provisional patent application No. 63/067,970, filed on Aug. 20, 2020; the entirety of which is hereby incorporated by reference herein.

BACKGROUND OF THE INVENTION

Field of the Invention

The invention relates to a paddleboard paddle system that is convertible from a single paddle to a double-paddle and has a paddle handle including a hand aperture and thumb aperture in the paddle portion.

Background

Paddleboarding has become very popular and the paddle typically used has just one paddle portion and is held at the end of the paddle arm. Many people however like to rest or alternate from standing to sitting on the paddle board. The single paddle is not very effective when sitting as the user has to switch from one side to another to keep the paddleboard moving in a straight line.

SUMMARY OF THE INVENTION

The invention is directed to a paddleboard paddle system that is convertible from a single paddle to a double-paddle and has a paddle handle which includes a hand aperture and may include a thumb aperture in the paddle portion. An exemplary paddleboard paddle has a first paddle portion and a second paddle portion that can be connected to form a double-paddle, or a paddle having a paddle portion on opposing ends of the paddle arm. A paddle arm is the rod, shaft or extension from the paddle portion that is typically used to guide the paddle through the water. A user may use the single paddle while standing on the paddle board or may connect the second paddle portion to produce the double-paddle to use while sitting on the paddleboard or for use in a canoe or kayak. Also, a user may use a double-paddle while standing, wherein the paddle handle on a first paddle portion may be gripped by the user to guide the opposing end and opposing paddle portion through the water.

An exemplary paddleboard paddle may be connected by connecting a first paddle arm coupled with a first paddle portion with a second paddle arm from a second paddle portion by a coupling device, which may be a collar that is configured on one of the paddle arms. A coupling device such as a collar, may be tighten to secure the two paddle arms together, A first paddle arm may be slightly smaller in diameter than a second paddle arm and be configured to slide within the second paddle arm, wherein the paddle arms are concentrically coupled paddle arms, one configured within the other. In this concentric embodiment, the collar may be configured on the outer paddle arm, or the paddle arm with a larger diameter for receiving the first paddle arm. A tightening clamp may be configured with the collar to secure the collar anywhere along the length of the other paddle arm. A coupling device may include a lever, which may be coupled with a collar. The lever may be opened to reduce the pressure and friction between the concentrically coupled paddle arms and closed to tighten the outer paddle arm down around the first paddle arm. A coupling device may be an internal coupling device configured inside a paddle arm, whereby rotation of one paddle arm with respect to the other secures the two paddle arms together in a desired location to produce a double-paddle having a desired length. The paddle arms may be slid to lengthen or shorten the length of the paddle arm between the two paddle portions and then rotated to fix this length. A paddle arm from a first paddle portion may connect with a second paddle portion directly as well.

An exemplary first paddle portion may have a length adjustable portion to enable the first paddle arm of the first paddle portion to be adjusted in length as desired. A paddle arm extension may extend from the paddle portion and the length adjustable portion may be more proximal to the connection end. The length adjustable portion may be slide over, for example the paddle arm extension and then be secured in position to change the length of the paddle arm of the first paddle portion. Again, any suitable tightening feature may be used including, but not limited to, an internal coupling device, a collar, or a collar with a clamp or lever tightening feature.

An exemplary paddle portion comprises a paddle handle or an aperture or set of apertures in the paddle portion to enable gripping the paddle portion to maneuver the opposing paddle portion through the water. An exemplary paddle handle comprises a hand aperture and a thumb aperture with a grip portion configured therebetween. The hand aperture may be larger in area than the thumb aperture, such as about 30% greater or more, about 50% greater or more, about 100% greater in area or more and any range between and including the percentages provided. The hand aperture may be configured more proximal to the paddle end of the paddle than the thumb aperture. The grip portion may be rounded or comprise curved surfaces to provide a more comfortable grip.

An exemplary paddleboard paddle comprises a closure flap that may be used to cover the hand and thumb apertures when the paddle portion is used as a paddle to propel a water craft, such as a paddleboard. The closure flap may be detachably attachable and may clip onto the paddle board portion, such as into the apertures. In an exemplary embodiment, the closure flap is coupled to the paddle portion by a pivot and the closure flap can be rotated about the pivot from a closed position, wherein it covers the hand and thumb apertures to an open position, wherein the hand and thumb apertures are exposed and open. A latch may be configured to hold the closure flap in an open and/or closed position. A closure latch may be configured on an opposing side of the hand and thumb apertures from the pivot whereby the closure flap will extend across the hand and thumb openings from the pivot to the closure latch. The open latch may be configured on the same side or end of the pivot and may be configured proximal to the paddle end, wherein the closure latch is configured proximal to the paddle arm. A closure flap may rotate from open to closed along a length axis of the paddle, wherein the pivot extends orthogonally to the length axis of the paddle. A user may open and close the closure flap as required for the intended use.

One or both of the paddle portions may have a paddle handle with a closure flap. In an exemplary embodiment, only one of the paddle portions has a paddle handle and may have a closure flap that is pivotably engaged with the paddle portion.

A first paddle arm extends from a first paddle portion and may have a paddle arm extension that extends to an extended end, when the paddle is a single paddle or to a connection end when the paddle is a double paddle. A paddle arm extension may extend from the paddle arm and may be detachably attachable. Also, a length adjustable portion of the paddle arm, which may be the paddle arm extension, may be configured to slide with respect to the first or second paddle arm to adjust the length of the paddle arm. The second paddle arm may have a similar construction with a second paddle arm extension coupled to the second paddle arm. The first and second paddle arms may be connected together to form a paddle arm that extends from the first paddle portion to the second paddle portion. The first paddle arm, second paddle arm or paddle arm extending between the first and second paddle portions may have a length of about 0.5 m or more, about 0.75 m or more, about 1 m or more, about 1.5 m or more, about 2 m or more about 2.5 m or more and any range between and including the length values provided.

The paddle panel is the portion of the paddle portion that is configured to be moved through the water to propel a water craft, such as a boat, a paddleboard and the like. The paddle panel may be tear drop shaped and be a thin sheet or of material having a thickness of no more than about 3 cm, or no more than about 2 cm and the like. The paddle panel may have some curvature or contoured surfaces to aid in propelling the water when forced through the water.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
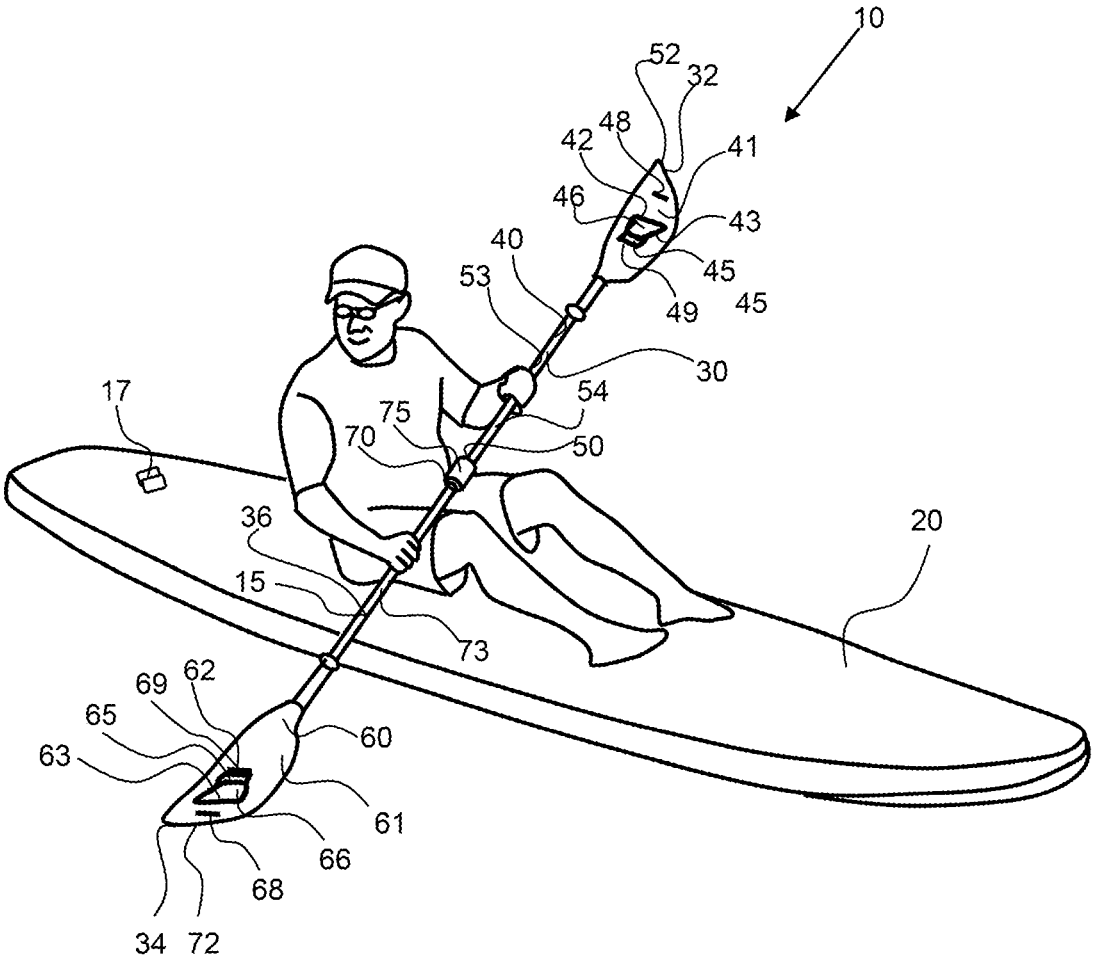
FIG. 1 shows a perspective view of a person sitting on a paddleboard holding an exemplary paddleboard paddle having a paddle handle comprising a hand and thumb aperture configured in the paddle portion to enable using the paddle portion as a handle.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one of features described and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 3:
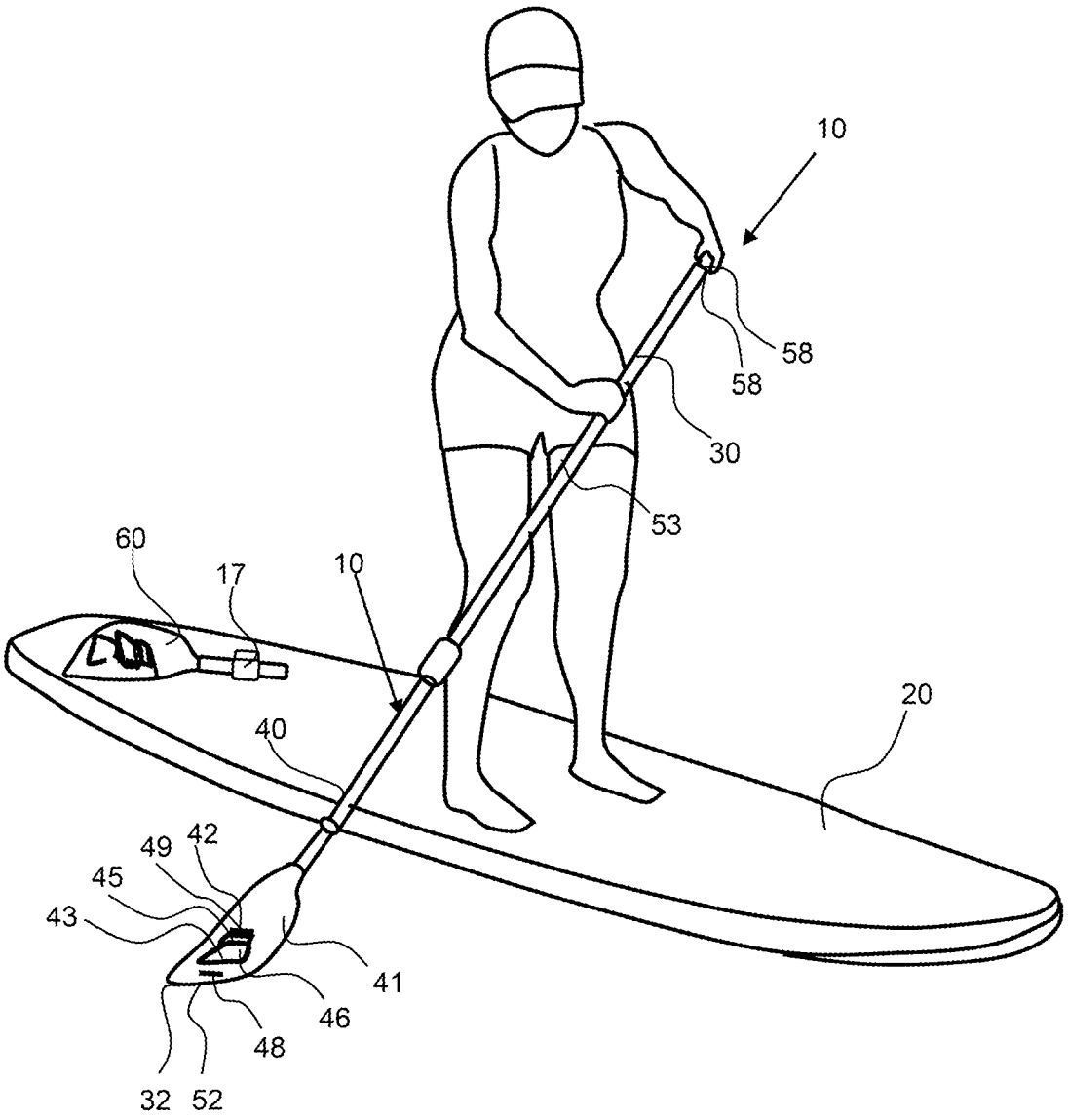
FIG. 3 shows a perspective view of a person standing on a paddleboard holding an exemplary paddleboard paddle by the paddle arm.

As shown in FIG. 1, a person is sitting on a paddleboard 20 and is holding an exemplary paddleboard paddle 30 having a first paddle portion 40 and a second paddle portion 60 on opposing ends of the paddle arm 36 or shaft to produce a double-paddle 15. The first paddle portions comprise a paddle handle 42 and the second paddle portion has a paddle handle 62. The first paddle handle includes a hand aperture 43 and thumb aperture 45 configured under a closure flap 46 and likewise the second paddle handle includes a hand aperture 63 and thumb aperture configured under a closure flap 66. The user is sitting so he is holding the paddle by the first paddle arm 53 and second paddle arm 73 extending from the first paddle portion 40 and second paddle portion 60, respectively. The first and second paddle arms are coupled together by a connection collar 75. The first paddle portion has a length adjustable portion 54 to allow the length from the first end 32 to the second end 34 of the paddleboard paddle 30 to be adjusted. This paddleboard paddle system 10 enables versatility in the use of the paddleboard paddle from having two paddle portions to having a single paddle portion. A paddle portion retainer 17 is configured on the paddleboard 20 to retain one of the first or second paddle portions when the paddleboard paddle is converted into a single paddle 13, as shown in FIG. 3. The paddleboard paddle 30 has a length from a first paddle end 52 to second paddle end 72, at the end of the second paddle panel 61.

Figure 2:
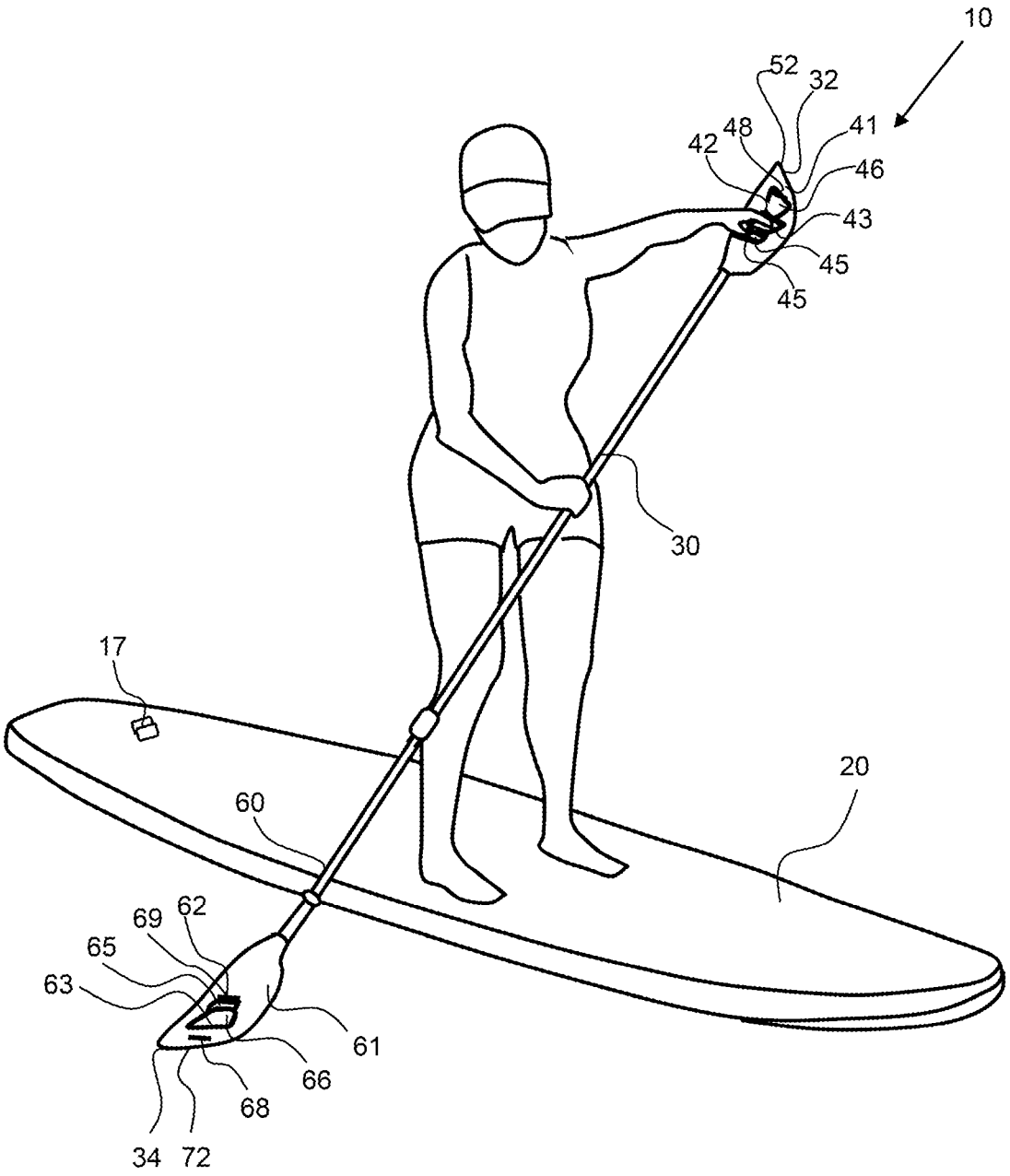
FIG. 2 shows a perspective view of a person standing on a paddleboard holding an exemplary paddleboard paddle by the paddle handle with their hand extending through the hand and thumb apertures and using the paddle handle to paddle the paddleboard.

As shown in FIG. 2, a person is standing on a paddleboard 20 and is holding an exemplary paddleboard paddle 30 by the paddle handle 42 of the first paddle portion 40. Their hand extends through the hand aperture 43 and their thumb extends through the thumb aperture 45. There is a grip portion between the hand and thumb apertures that allows the person to manipulate the paddleboard paddle to drive the second paddle portion 60 through the water to propel the paddle board. The closure flap 46 is opened to expose the hand and thumb apertures on the first paddle portion and the closure flap 66 of the second paddle portion 60 is closed to prevent water from passing through the hand and thumb apertures. In FIG. 1, the closure flap was closed on both the first and second paddle portions as the user was using both paddle portions to paddle through the water.

As shown in FIG. 3, a person is standing on a paddleboard 20 and is holding an exemplary paddleboard paddle 30 by the single-paddle handle 58 on the connection end 50 of the first paddle arm 53. The paddle panel 41 of the first paddle portion is in the water with the closure flap 46 in a closed orientation to prevent water from passing through the hand aperture 43 and thumb aperture 45. The second paddle portion 60 is on the paddleboard 20 and is retained by the paddle portion retainer 17.

Figure 4:
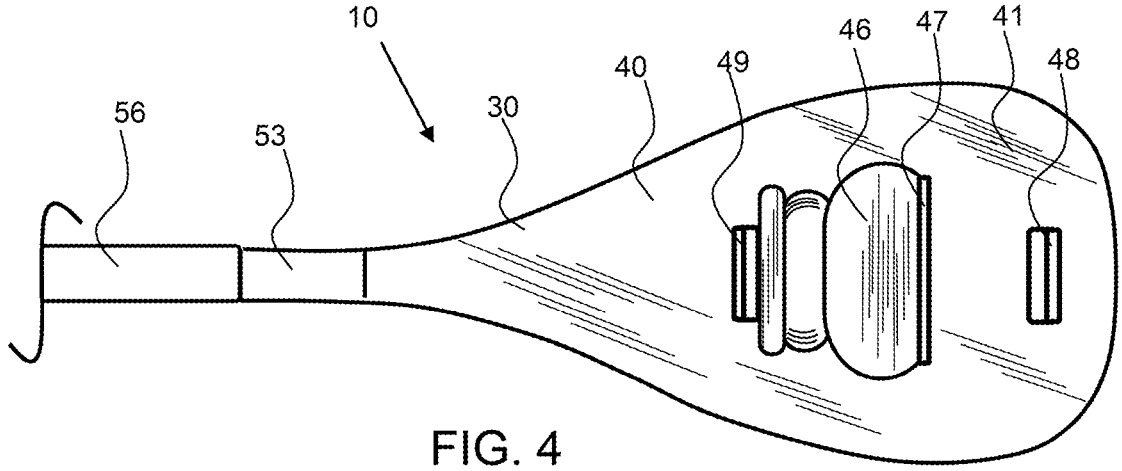
FIG. 4 shows a front view of an end portion of an exemplary paddleboard paddle having a paddle handle comprising a hand and thumb aperture configured under the closure flap that is configured in a closed position.
Figure 5:
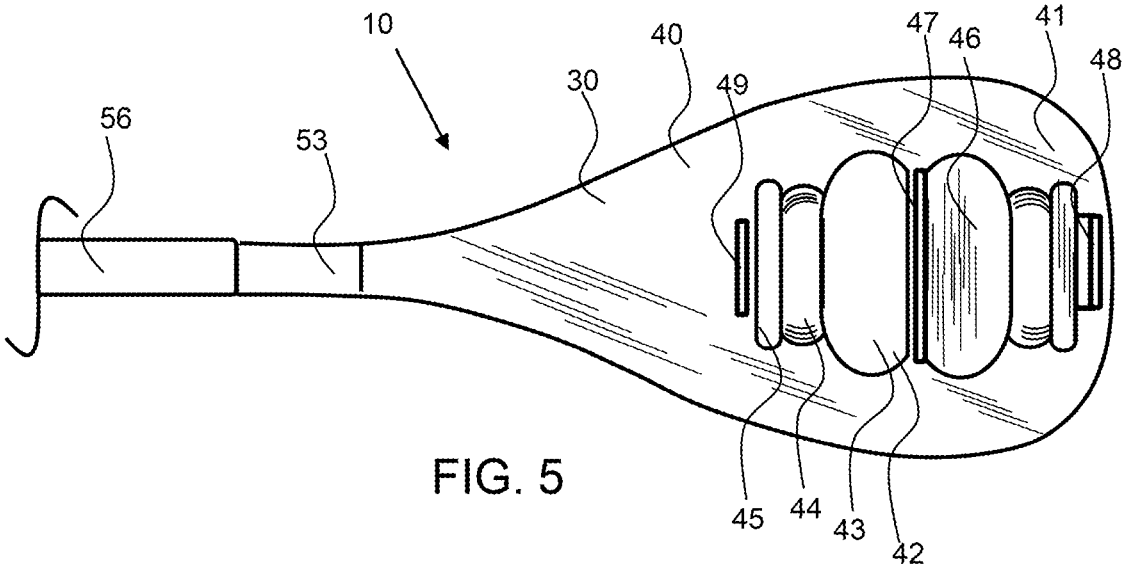
FIG. 5 shows a front view of an end portion of the exemplary paddleboard paddle shown in FIG. 4, with the closure flap in the open position thereby exposing the hand and thumb apertures.
Figure 6:
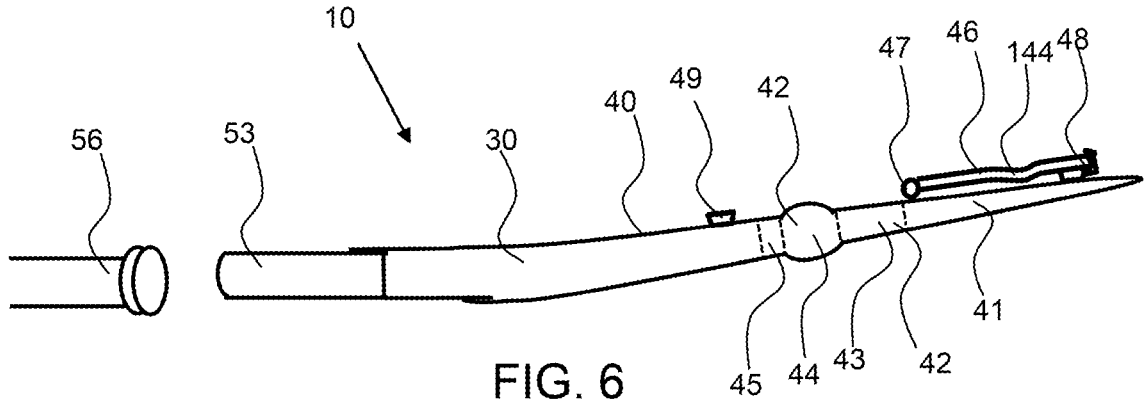
FIG. 6 shows a side view of the end portion of the exemplary paddleboard paddle shown in FIG. 5, with the closure flap in the open position thereby exposing the hand and thumb apertures.

Referring now to FIGS. 4 to 6, the first paddle portion 40 of a paddleboard paddle 30 has a paddle handle 42 comprising a hand aperture 43 and a thumb aperture 45 configured in the paddle panel 41. A closure flap 46 is configured to rotate to open and close the hand and thumb apertures. As shown in FIG. 4, the closure flap is rotated over about a pivot 47 to latch with the closure latch 49 to close the hand aperture and thumb aperture. As shown in FIG. 5, the closure flap 46 is rotated about the pivot 47 and is now secured in the open latch 48 to expose the hand aperture 43, and the thumb aperture 45. As best shown in FIG. 6, a grip portion 44 is configured between the hand and thumb apertures and may be rounded or have a curved or radiused surface to provide some comfort as a grip for a user's hand. Also note that the closure flap 46 has a contoured portion 144 to extend over the curved grip portion 44. The paddle handle 42 can be exposed or closed depending on the orientation of the closure flap 46 in either an open or closed position.

The first paddle portion 40 has a paddle arm 53 that extends from the paddle panel 41. The paddle arm extension 56 may be detachably attachable to the paddle arm 53, as shown in FIG. 6.

Figure 7:
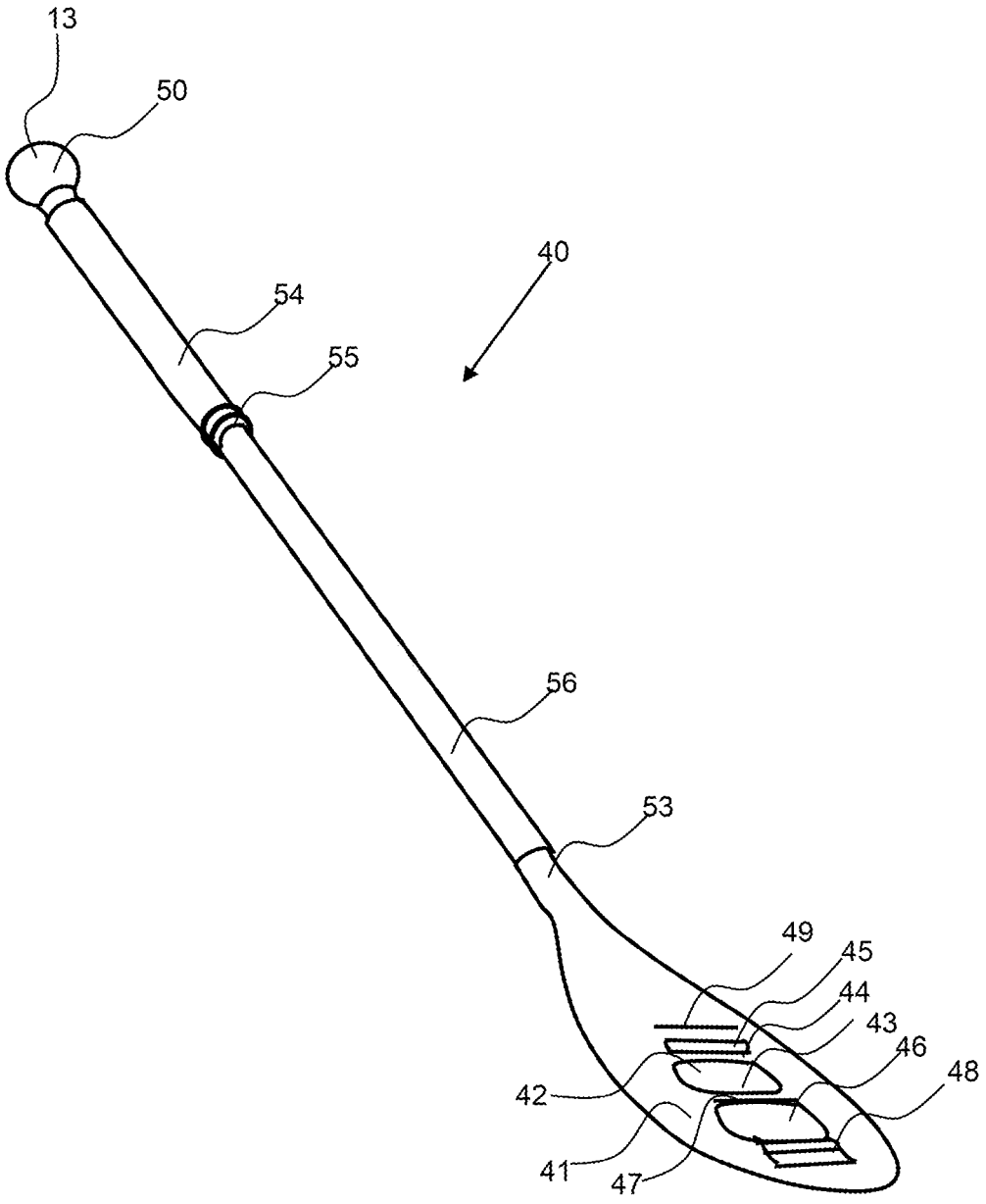
FIG. 7 shows a perspective view of a first paddle portion having a paddle handle and an adjustable length portion configured proximal to the connection end of the paddle arm.

As shown in FIG. 7, the paddle arm 53 or paddle arm extension 56 may extend to a length adjustable portion 54, wherein the length of the paddle portion can be changed according to a user's preference. The length adjustable portion may slide into or over the paddle arm or paddle arm extension and then be secured by a length adjustment collar 55. This single paddle 13 extends to the connection end 50 of the first paddle portion. The length adjustable portion 54 may have a ball or closure on the end for use to manipulate the paddle during use.

Figure 8:
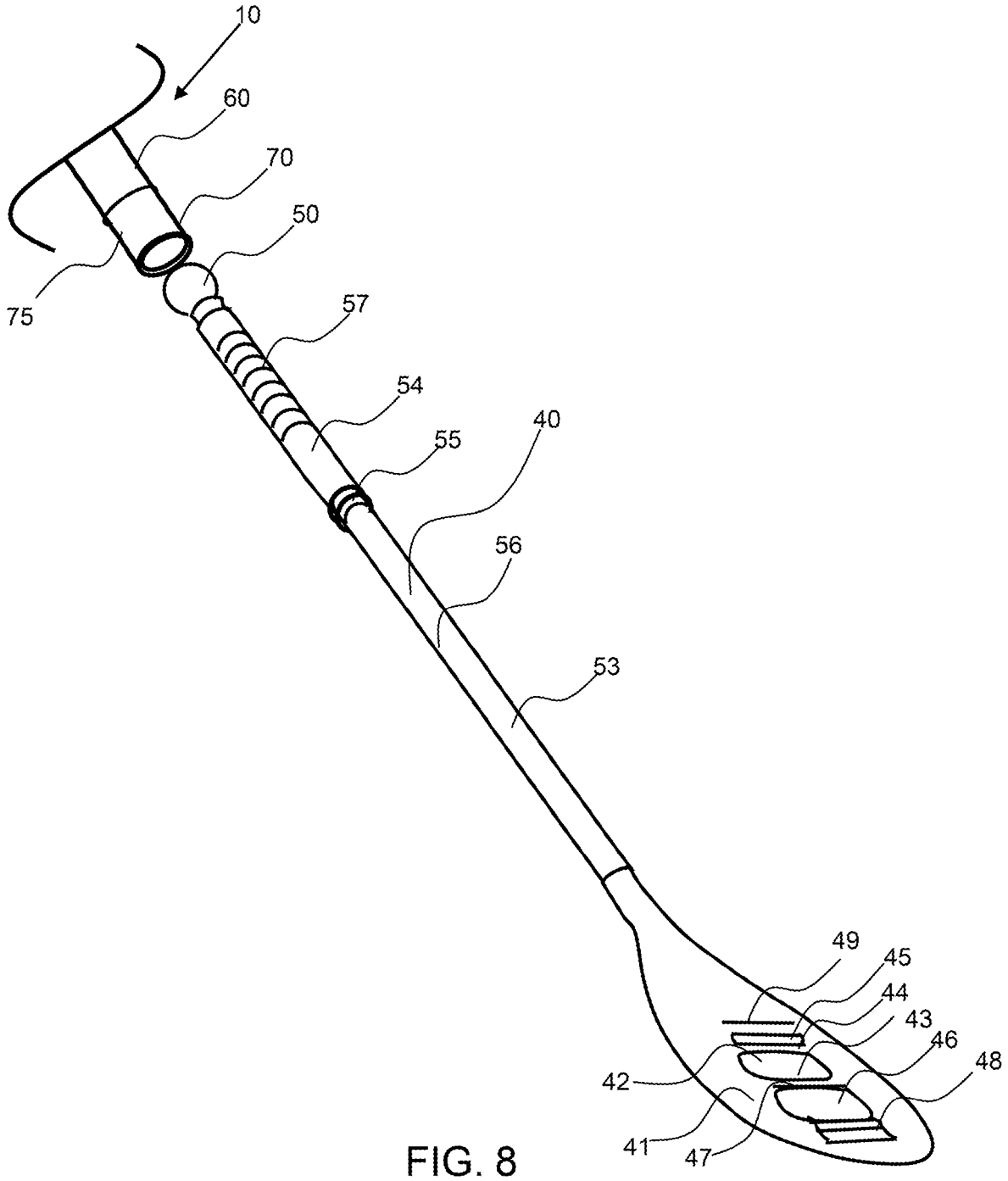
FIG. 8 shows a perspective view of a first paddle portion with the connection end being inserted into the connection end of the second paddle portion and the connection collar on the second paddle portion to retain the first and second paddle portions together.

As shown in FIG. 8, the second paddle portion 60 is being coupled to the first paddle portion 40 by the connection end 70 being inserted over the connection end 50 of the first paddle portion. A connection collar 75 on the second paddle portion may be configured to retain the first and second paddle portions together in a desired position. Length markings 57 may be configured on the length adjustable portion 54 of the paddle arm 53 of the first paddle portion 40. A paddle arm 53 may include a paddle arm extension 56 that extends from the paddle arm and a length adjustable portion 54 may be configured to slide with respect to the paddle arm extension to change the length of the paddle arm.

Figure 9:
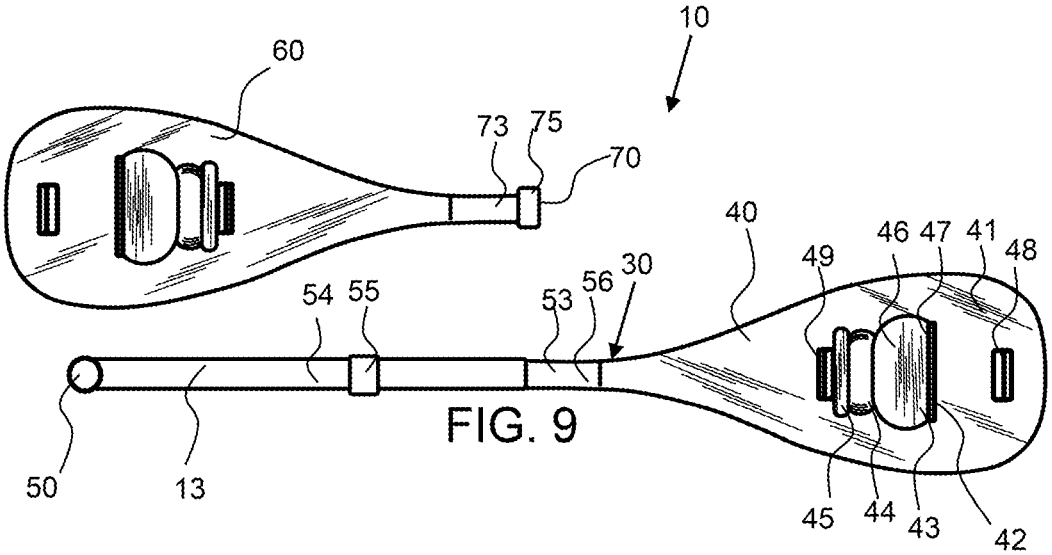
FIG. 9 shows a front view of an exemplary paddleboard paddle assembly having a first and second paddle portion detached from one another.
Figure 10:
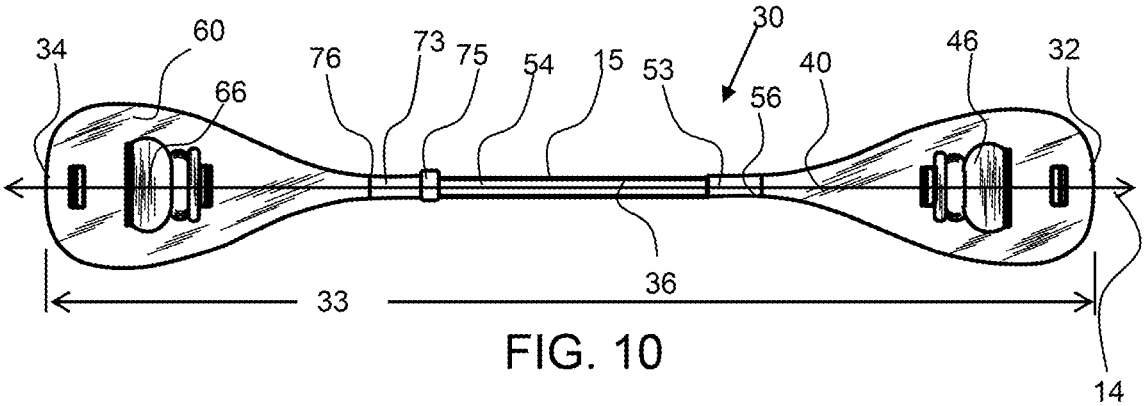
FIG. 10 shows a front view of an exemplary paddleboard paddle assembly having the first paddle portion detachably attached to the second paddle portion and the length reduced by the length adjustable portion of the first paddle portion.
Figure 11:
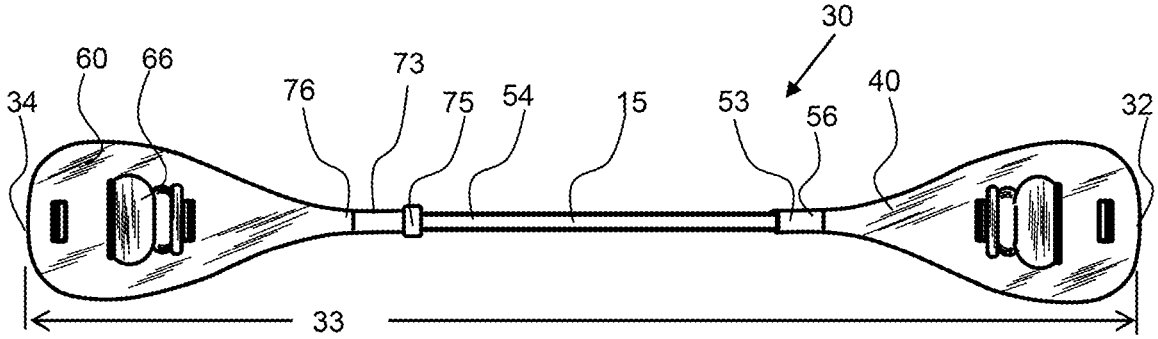
FIG. 11 shows a front view of an exemplary paddleboard paddle assembly of FIG. 10 now having the length increased by the length adjustable portion of the first paddle portion.

Referring now to FIGS. 9 to 11, an exemplary paddleboard paddle system comprises a paddleboard paddle 30 that can be converted from a single paddle 13 or first paddle portion 40 to a double-paddle 15 as shown in FIGS. 10 and 11. The second paddle portion 60 may be detachably attached to the first paddle portion by connection of the connection end 70 with the connection end 50 of the first paddle portion. The length of the single-paddle may be adjusted and the length of the double paddle portion may be adjusted by the length adjustable portion 54 of the first paddle portion and the amount of overlap of the second paddle arm 73 over the first paddle arm 53 when the two paddle portions are connected. The paddle system may include a connection collar 75, such as on the connection end of the second paddle portion 60 for connecting the first paddle portion to the second paddle portion. Also, the first paddle portion may include a length adjustment collar 55 that enables the length adjustable portion 54 to be changed in length and then locked down in a desired length. The length adjustable portion of the first paddle portion may be concentric with the paddle arm 53 for length adjustment.

As shown in FIG. 10, the paddleboard paddle 30 has a length 33 from a first end 32 to a second end 34 and a length axis 14 that extends along the paddle arm 36 from the first paddle portion 40 to the second paddle portion.

Figure 12:
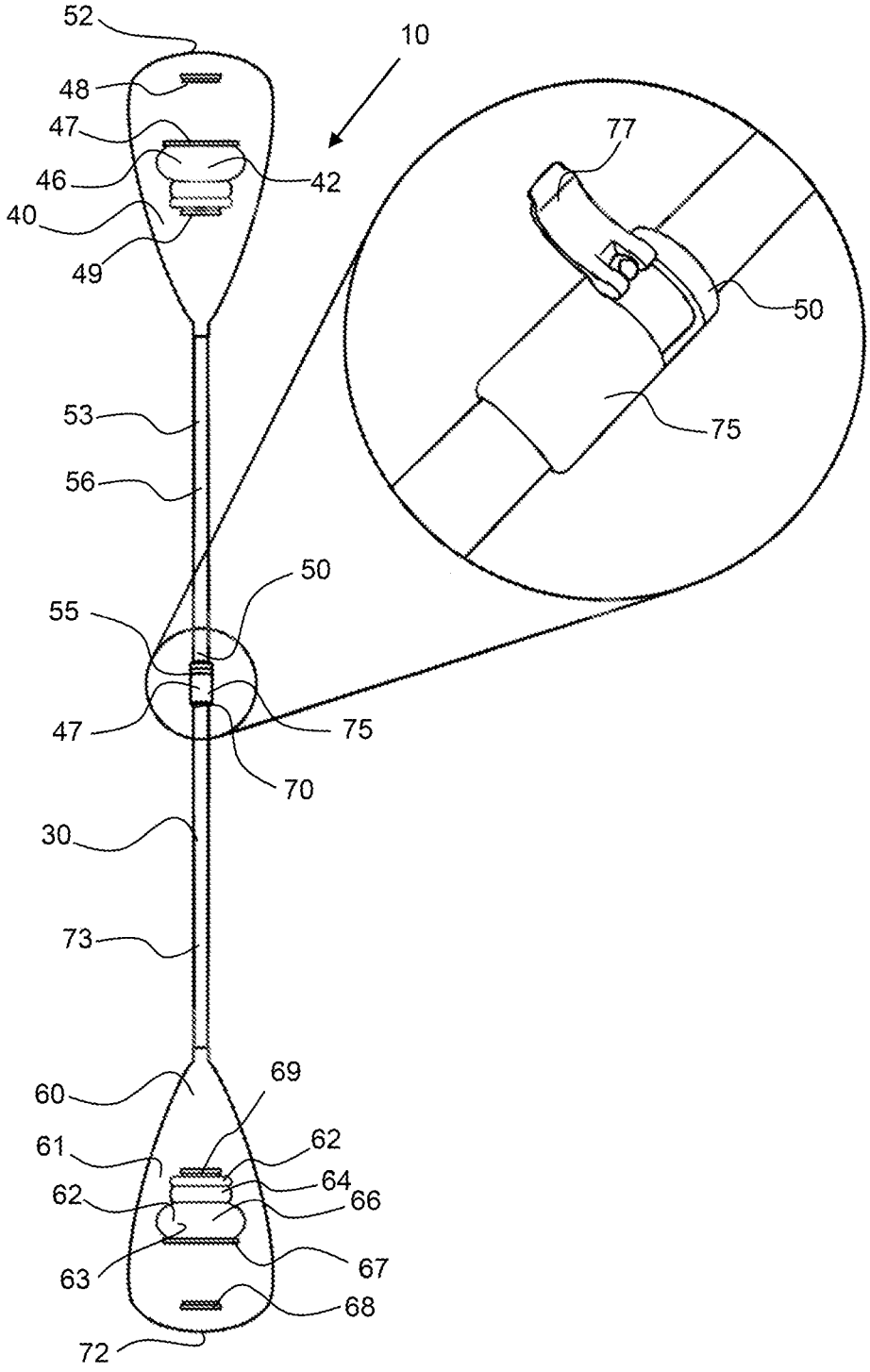
FIG. 12 shows a front view of an exemplary paddleboard paddle assembly have a first paddle arm coupled to a second paddle arm by a coupling device including a connection collar having a connection lever.

As shown in FIG. 12, an exemplary paddleboard paddle system 10 comprises a paddleboard paddle 30 that is a double-paddle 15 having a first paddle portion 40 coupled to a second paddle portion 60 by a connection collar 75. The connection collar has a connection lever 77 that is shown in an open position in the enlarged portion of the view. The connection end 50 of the first paddle portion or paddle arm 53 is slid into the paddle arm 73 of the second paddle portion and moved to a desired position before the connection lever is closed to secure the first paddle arm to the second paddle arm. The second paddle portion 60 has a paddle handle 62 in the paddle panel 61. The paddle handle has a closure flap 66 configured over the hand aperture 63, grip portion 64 and thumb aperture 65. The paddle handle rotates about a pivot 67 from an open latch 68 to a closure latch 69.

Figure 13:
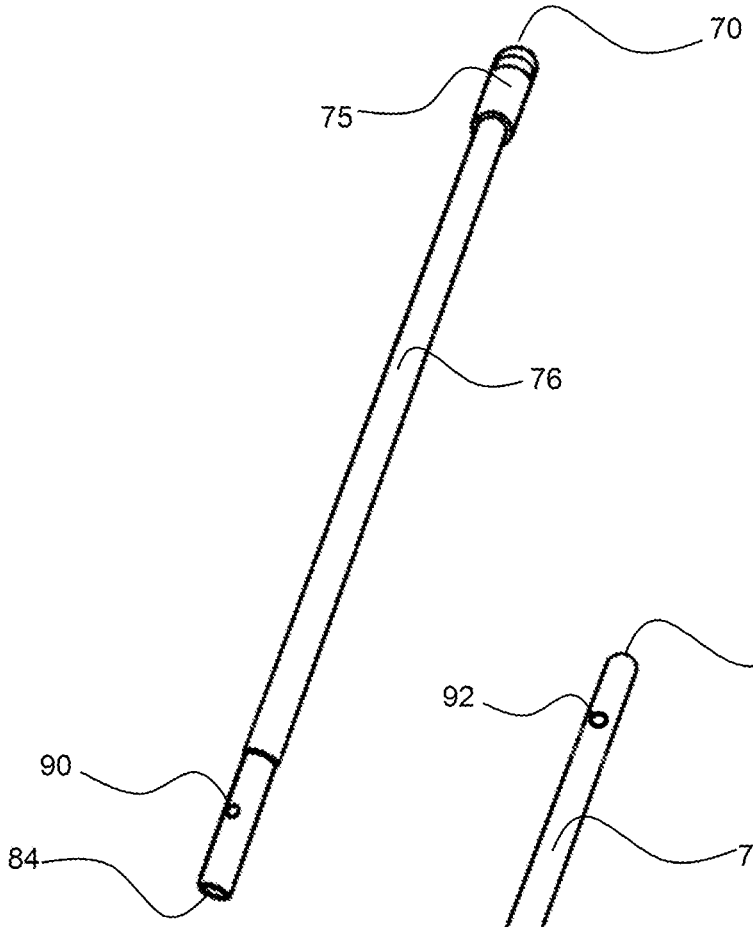
FIG. 13 shows a perspective view of an exemplary paddleboard paddle extension having a ball configured to extend into the aperture of the paddle arm of the second paddle portion.
Figure 14:
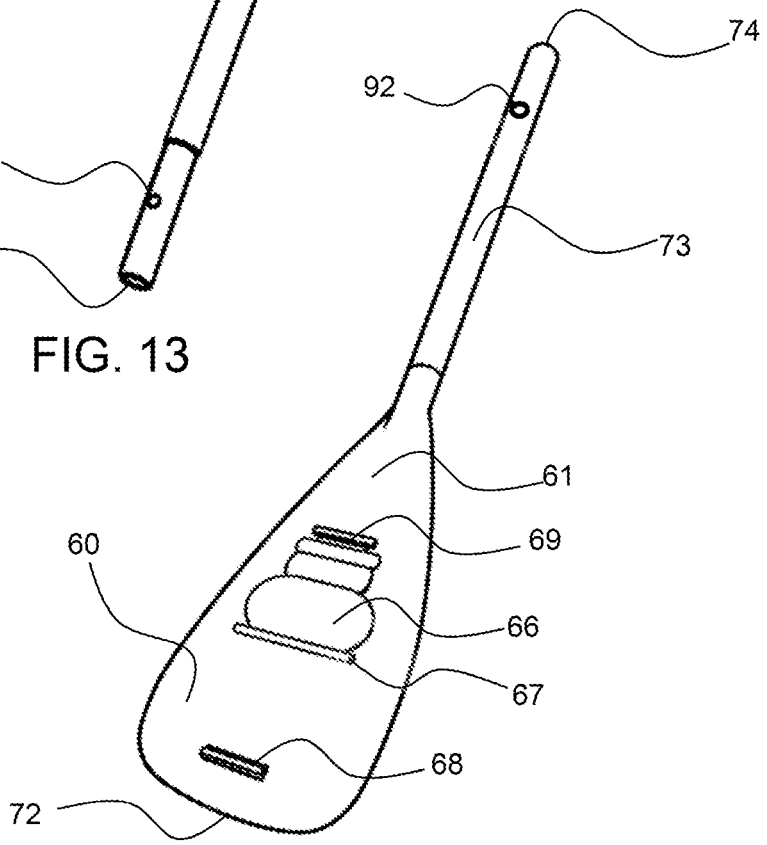
FIG. 14 shows a perspective view of an exemplary paddleboard paddle portion having a paddle arm having a aperture for receiving the ball on the paddleboard paddle extension shown in FIG. 13.

As shown in FIGS. 13 and 14, an exemplary paddleboard paddle system comprises a second paddle portion 60 and second paddle arm extension 76 having a ball-aperture configuration for detachably attaching the second paddle arm extension to the second paddle portion 60, or more particularly to the second paddle arm 73. The second paddle arm extension 76 may comprise the ball 90 of the ball-aperture coupler and the second paddle arm may comprise the aperture 92 for receiving the ball. The ball may extend partially though the aperture to retain the second paddle arm extension to the second paddle arm. The ball may be pushed inward to release the two components to detach them. The arm end 74 of the second paddle arm 73 may be slid over the coupler end 84 of the second paddle arm extension 76. A connection collar 75 may be configured on the connection end of the paddle arm extension for coupling with the first paddle arm extension 56, as shown in FIG. 12.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A paddleboard paddle assembly comprising:

a) a first paddle portion comprising:

i) a connection end;

ii) a paddle end;

iii) a paddle portion configured on the paddle end and comprising a paddle panel; and iv) a paddle arm extending from the paddle portion;

b) a second paddle portion comprising:

i) a connection end;

ii) a paddle end;

iii) a paddle portion configured on the paddle end and comprising a paddle panel; and iv) a paddle arm extending from the paddle portion;

wherein the connection end of the first paddle portion is configured for insertion into the connection end of the second paddle portion to detachably attach to the first paddle portion to the second paddle portion;

wherein at least one of the first or second paddle portions comprises a paddle handle comprising:

a hand aperture configured through the paddle panel;

a thumb aperture configured through the paddle panel; and a grip portion configured between the hand aperture and the thumb aperture.

2. The paddleboard paddle assembly of claim 1, wherein the paddle handle further comprises a closure flap configured to extend over the hand and thumb apertures.

3. The paddleboard paddle assembly of claim 2, wherein the closure flap is detachably attachable to the paddle portion.

4. The paddleboard paddle assembly of claim 3, wherein the closure flap comprises a pivot and wherein the closure flap is pivotably engaged with said pivot to pivot from an open position, wherein the hand aperture and thumb aperture are exposed, to a closed position wherein the hand aperture and thumb aperture are covered by the closure flap.

5. The paddleboard paddle assembly of claim 4, wherein the paddle handle further comprises an open latch configured on the paddle portion and configured to retain the closure flap in said open position.

6. The paddleboard paddle assembly of claim 5, wherein the paddle handle further comprises closure latch configured on the paddle portion and configured to retain the closure flap in said closed position.

7. The paddleboard paddle assembly of claim 6, wherein the closure latch is configured more proximal to the paddle end than the open latch.

8. The paddleboard paddle assembly of claim 1, wherein the grip portion comprises a curved surface between the hand aperture and the thumb aperture.

9. The paddleboard paddle assembly of claim 1, wherein the hand aperture is larger in open area than the thumb aperture.

10. The paddleboard paddle assembly of claim 1, wherein the hand aperture is configured more proximal to the paddle end than the thumb aperture.

11. The paddleboard paddle assembly of claim 1, wherein the paddle handle further comprises:

a closure flap configured to extend over the hand and thumb apertures;

wherein the closure flap comprises a pivot and wherein the closure flap is pivotably engaged with said pivot to pivot from an open position, wherein the hand aperture and thumb aperture are exposed, to a closed position wherein the hand aperture and thumb aperture are covered by the closure flap;

open latch configured on the paddle portion and configured to retain the closure flap in said open position;

a closure latch configured on the paddle portion and configured to retain the closure flap in said closed position;

wherein the hand aperture is larger in open area than the thumb aperture, and wherein the hand aperture is configured more proximal to the paddle end than the thumb aperture.

12. The paddleboard paddle assembly of claim 11, wherein the closure latch is configured more proximal to the paddle end than the open latch.

13. The paddleboard paddle assembly of claim 1, further comprising a single-paddle handle configured on the connection end of the first paddle portion.

14. The paddleboard paddle assembly of claim 1, wherein the paddle arm of the first paddle portion comprises a paddle arm extension that extends toward the connection end from the paddle arm of the first paddle portion.

15. The paddleboard paddle assembly of claim 14, wherein the paddle arm extension is detachably attachable to the paddle arm of the first paddle portion.

16. The paddleboard paddle assembly of claim 15, wherein the paddle arm extension is detachably attachable to the paddle arm of the first paddle portion, wherein the paddle arm extension comprises a ball and wherein the paddle arm of the first paddle portion comprises an aperture for receiving said ball.

17. The paddleboard paddle assembly of claim 14, wherein the paddle arm extension comprises a length adjustable portion that is concentric with the paddle arm extension and slides with respect to the paddle arm extension to change the length of the paddle arm of the first paddle portion.

18. The paddleboard paddle assembly of claim 1, wherein the paddle arm of the first paddle portion comprises a length adjustable portion that is concentric with said paddle arm and slides with respect to said paddle arm to change the length of the paddle arm of the first paddle portion.

19. The paddleboard paddle assembly of claim 1, wherein the second paddle portion comprises a connection collar on a connection end of the paddle arm of the second paddle portion for securing the second paddle portion to the paddle arm of the first paddle portion.

20. The paddleboard paddle assembly of claim 1, wherein both the first paddle portion and the second paddle portion each comprise a paddle handle.

* * * * *